US007977882B2

(12) United States Patent
Okada et al.

(10) Patent No.: US 7,977,882 B2
(45) Date of Patent: Jul. 12, 2011

(54) PLASMA DISPLAY PANEL HAVING LAMINATED DIELECTRIC LAYER

(75) Inventors: Takeru Okada, Yamanashi (JP); Kenji Kawai, Yamanashi (JP)

(73) Assignee: Panasonic Corporation, Kadoma (JP)

( * ) Notice: Subject to any disclaimer, the term of this patent is extended or adjusted under 35 U.S.C. 154(b) by 487 days.

(21) Appl. No.: 12/124,636

(22) Filed: May 21, 2008

(65) Prior Publication Data

US 2009/0021170 A1 Jan. 22, 2009

(30) Foreign Application Priority Data

Jul. 17, 2007 (JP) ..... 2007-185447

(51) Int. Cl.
*H01J 17/49* (2006.01)

(52) U.S. Cl. ..... 313/586; 313/582

(58) Field of Classification Search ..... 313/586, 313/587, 582
See application file for complete search history.

(56) References Cited

U.S. PATENT DOCUMENTS

| | | | | |
|---|---|---|---|---|
| 6,450,849 | B1 * | 9/2002 | Harada | 445/24 |
| 2003/0038599 | A1 * | 2/2003 | Aoki et al. | 313/587 |
| 2004/0256990 | A1 * | 12/2004 | Fujitani | 313/586 |
| 2005/0206316 | A1 * | 9/2005 | Lee et al. | 313/582 |
| 2006/0076892 | A1 * | 4/2006 | Fujitani | 313/586 |
| 2006/0186811 | A1 * | 8/2006 | Sasaki et al. | 313/582 |
| 2006/0255731 | A1 * | 11/2006 | Shibata et al. | 313/582 |
| 2007/0013311 | A1 * | 1/2007 | Moon et al. | 313/586 |
| 2007/0096653 | A1 * | 5/2007 | Jeong et al. | 313/586 |
| 2007/0126361 | A1 * | 6/2007 | Lee | 313/586 |
| 2007/0228958 | A1 * | 10/2007 | Lee et al. | 313/582 |
| 2007/0241685 | A1 * | 10/2007 | Shiina et al. | 313/586 |
| 2008/0224613 | A1 * | 9/2008 | Yoo et al. | 313/587 |

FOREIGN PATENT DOCUMENTS

| | | | |
|---|---|---|---|
| JP | 2007-083438 | A | 4/2007 |
| JP | 2007-087636 | A | 4/2007 |
| WO | WO 2007023658 | A1 * | 3/2007 |
| WO | WO 2007094202 | A1 * | 8/2007 |
| WO | WO 2007105467 | A1 * | 9/2007 |

* cited by examiner

*Primary Examiner* — Nimeshkumar D Patel
*Assistant Examiner* — Glenn Zimmerman
(74) *Attorney, Agent, or Firm* — Arent Fox LLP

(57) ABSTRACT

A PDP is equipped with row electrode pairs deposited on the inner face of a front glass substrate and a dielectric layer covering the row electrode pairs. A discharge space defined between the front glass substrate and the back glass substrate is filled with a discharge gas. The dielectric layer has a laminated structure made up of a first dielectric layer formed of a smaller nano-particle silica film including silica particles of a particle diameter of 10 nm to 25 nm, and a second dielectric layer formed of a larger nano-particle silica film including silica particles of a particle diameter of 25 nm to 40 nm.

4 Claims, 10 Drawing Sheets

*FIRST EMBODIMENT*

FIRST EMBODIMENT

α : 40 nm-DIAMETER LARGER NANO-PARTICLE SILICA FILM ALONE

β : 20 nm-DIAMETER SMALLER NANO-PARTICLE SILICA FILM ALONE

γ : LARGER NANO-PARTICLE SILICA FILM (40 nm PARTICLE DIAMETER)+ SMALLER NANO-PARTICLE SILICA FILM(20 nm PARTICLE DIAMETER)

a : SMALLER NANO-PARTICLE SILICA FILM(20 nm PARTICLE DIAMETER) +LARGER NANO-PARTICLE SILICA FILM (40 nm PARTICLE DIAMETER)

b : SMALLER NANO-PARTICLE SILICA FILM(20 nm PARTICLE DIAMETER) ALONE c : LARGER NANO-PARTICLE SILICA FILM (40 nm PARTICLE DIAMETER) ALONE d : LARGER NANO-PARTICLE SILICA FILM (40 nm PARTICLE DIAMETER) +SMALLER NANO-PARTICLE SILICA FILM(20 nm PARTICLE DIAMETER)

SECOND EMBODIMENT e: SMALLER NANO-PARTICLE SILICA FILM + LEADLESS GLASS MATERIAL LAYER f: SMALLER NANO-PARTICLE SILICA FILM ALONE g: LEADLESS GLASS MATERIAL LAYER + SMALLER NANO-PARTICLE SILICA FILM h: SMALLER NANO-PARTICLE SILICA FILM + LEADLESS GLASS MATERIAL LAYER (7 μm THICK)

i: SMALLER NANO-PARTICLE SILICA FILM ALONE j: LEADLESS GLASS MATERIAL LAYER ALONE

THIRD EMBODIMENT

MODIFICATION

MODIFICATION k:SMALLER NANO-PARTICLE SILICA FILM + LEADLESS GLASS MATERIAL LAYER (7 μmTHICK)+ LEADLESS GLASS MATERIAL LAYER FACING BUS ELECTRODE l:SMALLER NANO-PARTICLE SILICA FILM ALONE m:SMALLER NANO-PARTICLE SILICA FILM + LEADLESS GLASS MATERIAL LAYER (7 μmTHICK)

δ :SMALLER NANO-PARTICLE SILICA FILM ALONE e:SMALLER NANO-PARTICLE SILICA FILM + LEADLESS GLASS MATERIAL LAYER FACING BUS ELECTRODE (7 μ mTHICK)

ξ :SMALLER NANO-PARTICLE SILICA FILM + LEADLESS GLASS MATERIAL LAYER (7 μ mTHICK) + LEADLESS GLASS MATERIAL LAYER FACING BUS ELECTRODE

η :LEADLESS GLASS MATERIAL LAYER ALONE

FOURTH EMBODIMENT

PLASMA DISPLAY PANEL HAVING LAMINATED DIELECTRIC LAYER

BACKGROUND OF THE INVENTION

1. Field of the Invention

This invention relates to a structure of plasma display panels.

The present application claims priority from Japanese Application No. 2007-185447, the disclosure of which is incorporated herein by reference.

2. Description of the Related Art

A plasma display panel (hereinafter referred to as "PDP") typically comprises a front glass substrate on the inner face of which a plurality of row electrode pairs are provided. The row electrode pairs each extend in a direction at right angles to column electrodes that are provided on a back glass substrate facing the front glass substrate across a discharge space. In this manner, discharge cells arranged in a matrix are formed in the respective positions in the discharge space corresponding to the intersections between the row electrode pairs and the column electrode. Thus, a discharge is initiated between one row electrode in the row electrode pair and the column electrode or between the row electrodes in each row electrode pair in each discharge cell. As a result, phosphor layers of the three primary colors, red, green and blue, provided in the respective discharge cells emit visible color lights to form a matrix-display image.

The row electrode provided in the PDP structured as described above is covered with a dielectric layer deposited on the inner face of the front glass substrate.

The dielectric layer has the functions of causing accumulation of surface charge (wall charge) for discharge generation and discharge limitation, as well as electrically isolating and protecting the row electrodes pairs.

Low-temperature-melting glass is typically used for such a dielectric layer overlying the row electrode pairs. On the other hand, conventionally, techniques of producing a dielectric layer of a composition including nanosized particles having a lower permittivity than that of the low-temperature-melting glass are suggested for a reduction in power consumption and an improvement in luminous efficiency of the PDP, as disclosed in Japanese Unexamined Patent Publication Nos. 2007-83438 and 2007-87636.

However, the dielectric layer formed of the conventional composition including nanosized particles is a porous dielectric layer of a single layer structure, and has the disadvantage of being incapable of having adequate resistance to the applied voltage.

SUMMARY OF THE INVENTION

It is a technical object of the present invention to solve the problem associated with conventional PDPs as described above.

To attain this object, an aspect of the present invention provides a PDP which comprises discharge electrodes deposited on the inner face of the front substrate and a dielectric layer overlying the discharge electrodes, with the front substrate facing a back substrate to define a discharge space filled with a discharge gas between them, wherein the dielectric layer has a lamination structure of a first dielectric layer including silica particles having a particle diameter of 40 nm or less, and a second dielectric layer different from the first dielectric layer.

In the best mode for carrying out the aspect of the present invention, a PDP comprises discharge electrodes deposited on the inner face of the front substrate and a dielectric layer overlying the discharge electrodes, with the front substrate facing a back substrate to define a discharge space filled with a discharge gas between them. The dielectric layer has a lamination structure of a first dielectric layer including silica particles having a particle diameter of 40 nm or less, and a second dielectric layer different from the first dielectric layer. For example, the dielectric layer has a lamination structure made up of the first dielectric layer which is formed of a small nano-particle silica film including silica particles having a particle diameter ranging from 10 nm to 25 nm, and the second dielectric layer which is formed of a large nano-particle silica film including silica particles having a particle diameter ranging from 25 nm to 40 nm. Alternatively, the dielectric layer has a lamination structure made up of the first dielectric layer formed of a small nano-particle silica film including silica particles having a particle diameter ranging from 10 nm to 25 nm, and the second dielectric layer formed of a leadless glass material.

In the PDP according to this embodiment, the dielectric layer has a lamination structure made up of a first dielectric layer and a second dielectric layer different from the first dielectric layer, and the first dielectric layer is formed of a small nano-particle silica film including silica particles having a particle diameter smaller than a predetermined particle-diameter, resulting in a reduction in electric power consumption and an improvement in luminous efficiency of the PDP. In addition, the second dielectric layer is formed of, for example, a larger nano-particle silica film or a leadless glass material layer, so that the film-thickness of the dielectric layer exceeds the film-thickness of the first dielectric layer. This makes it possible to attain voltage resistance properties sufficient to withstanding the applied voltage, which cannot be attained by the smaller nano-particle silica film alone. Further, a reduction in the light transmittance of the dielectric layer can be restrained as compared with the case when the dielectric layer is formed either the larger nano-particle silica film or the leadless glass material layer alone in order to enhance the voltage resistance properties.

In the above-described PDP, when the second dielectric layer is formed of a leadless glass material, the leadless glass material preferably includes at least one selected from the group consisting of $Bi_2O_3$ and ZnO.

In the aforementioned PDP, further, the larger nano-particle silica film or the leadless glass material layer, which forms the second dielectric layer, is preferably deposited on the first dielectric layer formed of the smaller nano-particle silica film.

In consequence, the occurrence of a crack in the smaller nano-particle silica film when the smaller nano-particle silica film is laminated on either the larger nano-particle silica film or the leadless glass material layer is prevented, which makes it possible to improve the product yield in the manufacturing process.

In the aforementioned PDP, the second dielectric layer preferably has a thickness ranging from 3 μm to 20 μm, leading to a further enhancement in the voltage resistance properties of withstanding the applied voltage.

In the aforementioned PDP, each of the discharge electrodes has a bus electrode extending in a row direction, and a transparent electrode connected to the bus electrode and facing another discharge electrode paired with the discharge electrode across a discharge gap. The second dielectric layer is preferably formed on an area facing a portion of the discharge electrode including the bus electrode, and a portion of the transparent electrode including the leading end close to the discharge gap is preferably covered with the first dielectric layer alone. In consequence, it is possible to more strongly electrically insulate the bus electrode (the voltage resistance properties) while maintaining the light transmittance of the dielectric layer in the area corresponding to the transparent electrode.

In the aforementioned PDP, each of the discharge electrodes has a bus electrode extending in a row direction, and a transparent electrode connected to the bus electrode and facing another discharge electrode paired with the discharge electrode across a discharge gap. The second dielectric layer preferably overlies the full face of the first dielectric layer, and a third dielectric layer is preferably deposited on a portion of the second dielectric layer facing a portion of the discharge electrode including the bus electrode. This makes it possible to enhance the voltage resistance properties of the dielectric layer and more strongly electrically insulate the bus electrode (the voltage resistance properties).

Preferably, the second dielectric layer and the third dielectric layer are both formed of a leadless glass material.

In the aforementioned PDP, the discharge gas preferably includes 15% or more of xenon, leading to an improvement in the luminous efficiency of the PDP.

To attain the aforementioned object, another aspect of the present invention provides a PDP which comprises discharge electrodes deposited on the inner face of a front substrate; and a dielectric layer overlying the discharge electrodes, with the front substrate facing a back substrate to define a discharge space filled with a discharge gas between them. Each of the discharge electrodes has a bus electrode extending in a row direction, and a transparent electrode connected to the bus electrode and facing another discharge electrode paired with the discharge electrode across a discharge gap. The dielectric layer has a fourth dielectric layer including silica particles having a particle diameter of 40 nm or less and a fifth dielectric layer different from the fourth dielectric layer. The fourth dielectric layer covers the transparent electrode of the discharge electrode. The fifth dielectric layer covers the bus electrode of the discharge electrode and protrudes further into the discharge space than the fourth dielectric layer does.

In the best mode for carrying out this aspect of the present invention, a PDP comprises discharge electrodes deposited on the inner face of a front substrate; and a dielectric layer overlying the discharge electrodes. The front substrate faces a back substrate to define a discharge space filled with a discharge gas between them. Each of the discharge electrodes has a bus electrode extending in a row direction, and a transparent electrode connected to the bus electrode and facing another discharge electrode paired with the discharge electrode across a discharge gap. The dielectric layer has a fourth dielectric layer including silica particles having a particle diameter of 40 nm or less and a fifth dielectric layer different from the fourth dielectric layer. The fourth dielectric layer covers the transparent electrode of the discharge electrode. The fifth dielectric layer covers the bus electrode of the discharge electrode and protrudes further into the discharge space than the fourth dielectric layer does. In this embodiment, the fourth dielectric layer is preferably formed of a small nano-particle silica film including silica particles having a particle diameter ranging from 10 nm to 25 nm, and the fifth dielectric layer is preferably formed of a leadless glass material.

The PDP according to the above described embodiment is capable of making the electrical insulation (the voltage resistance properties) of the bus electrode even stronger.

To attain the aforementioned object, still another aspect of the present invention provides a PDP which comprises discharge electrodes deposited on the inner face of a front substrate and a dielectric layer overlying the discharge electrodes. The front substrate faces a back substrate to define a discharge space filled with a discharge gas between them. The dielectric layer is formed of a nano-silica film including silica particles having a particle diameter of 40 nm or less. Each of the discharge electrodes has a bus electrode extending in the row direction and a transparent electrode connected to the bus electrode and facing another discharge electrode paired with the discharge electrode across a discharge gap. Portions of the dielectric layer respectively facing the bus electrodes of the discharge electrodes protrude further into the discharge space than portions of the dielectric layer facing the transparent electrodes and the area excluding the bus electrodes.

In the best mode for carrying out this aspect of the present invention, a PDP comprises discharge electrodes deposited on the inner face of a front substrate and a dielectric layer overlying the discharge electrodes. The front substrate faces a back substrate to define a discharge space filled with a discharge gas between them. The dielectric layer is formed of a nano-silica film including silica particles having a particle diameter of 40 nm or less. Each of the discharge electrodes has a bus electrode extending in the row direction and a transparent electrode connected to the bus electrode and facing another discharge electrode paired with the discharge electrode across a discharge gap. Portions of the dielectric layer respectively facing the bus electrodes of the discharge electrodes protrude further into the discharge space than portions of the dielectric layer facing the transparent electrodes and the area excluding the bus electrodes. In this embodiment, preferably, the dielectric layer is formed of a nano-silica film including silica particles having a particle diameter of 40 nm or less, and also a ratio of a film-thickness of the portion of the dielectric layer facing the bus electrode to a film-thickness of the portion of the dielectric layer facing the transparent electrode of the discharge electrode is 0.5 or more.

The PDP according to the above described embodiment is capable of making the electrical insulation (the voltage resistance properties) of the bus electrode even stronger.

These and other objects and features of the present invention will become more apparent from the following detailed description with reference to the accompanying drawings.

DETAILED DESCRIPTION OF THE PREFERRED EMBODIMENTS

First Embodiment

Figure 1:
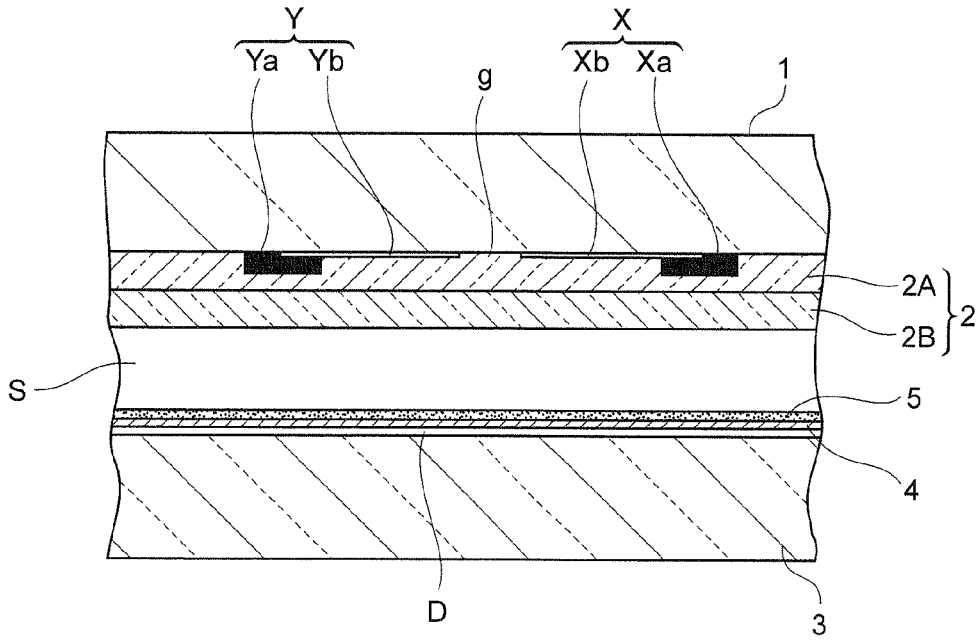
FIG. 1 is a sectional view illustrating a first embodiment of the PDP according to the present invention.

FIG. 1 is a sectional view illustrating a first embodiment of the exemplary embodiments of the PDP according to the present invention.

In FIG. 1, a plurality of row electrode pairs (X, Y), each extending in the row direction (the direction at right angles to the drawing in FIG. 1), are arranged parallel to each other in the column direction (the right-left direction in FIG. 1) on the inner face of the front glass substrate 1 which form part of the panel screen.

Each of the face-to-face row electrodes X, Y constituting each of the row electrode pairs (X, Y) is composed of a metal-formed bus electrode Xa (Ya) and a transparent electrode Xa (Ya). The transparent electrodes Xb and Yb in each row electrode pair (X, Y) extend out from the respective bus electrodes Xa and Ya so as to face each other across a discharge gap g.

In turn, a dielectric layer 2 is deposited on the inner face of the front glass substrate 1 so as to overlie the row electrode pairs (X, Y).

The structure of the dielectric layer 2 will be described in detail later.

The front glass substrate 1 is placed parallel to a back glass substrate 3 on either side of the discharge space S. On the inner face of the back glass substrate 3 facing the front glass substrate 1, a plurality of column electrodes D each extending in the column direction are arranged parallel to each other in the row direction, so that discharge cells are formed between the column electrodes D and the row electrode pairs (X, Y) in the discharge space S.

Then, a column-electrode protective layer 4 is deposited on the back glass substrate 3 so as to overlie the column electrodes D.

In turn, phosphor layers 5 are formed on the column-electrode protective layer 4, and differently colored according to the discharge cell pattern.

The discharge space S is filled with a discharge gas including 15% or more of xenon at a required pressure.

Next, the structure of the dielectric layer 2 will be described in detail.

The dielectric layer 2 has a double layer structure made up of a first dielectric layer 2A deposited on the inner face of the front glass substrate 1 and a second dielectric layer 2B laminated on the inner face of the first dielectric layer 2A.

The first dielectric layer 2A consists of a smaller-sized nano-particle silica film formed of nano-particle silica having a particle diameter from 10 nm to 25 nm.

The smaller nano-particle silica film is formed of a colloidal silica solution with a viscosity of 100 cP including polyvinyl alcohol with a 10% solid (silica particles) content. The smaller nano-particle silica film is calcined to form a porous silica dielectric layer having a relative permittivity of 2.6 (@100 kHz), a density of 60% and a light transmittance of 99% or more.

The second dielectric layer 2B consists of a larger-sized nano-particle silica film formed of nano-particle silica having a particle diameter from 25 nm to 40 nm and has a film-thickness set to 3 μm to 20 μm.

The reason why the dielectric layer 2 has the double layer structure of the first dielectric layer 2A and the second dielectric layer 2B will be described below.

When such a dielectric layer is formed of smaller nano-particle silica having a particle diameter of 10 nm to 25 nm alone, it is impossible to increase the film-thickness of the smaller nano-particle silica film. In turn, the desired voltage resistance properties to the voltage applied to the dielectric layer cannot be ensured.

On the other hand, when a dielectric layer is formed of larger nano-particle silica alone having a particle diameter of 25 nm to 40 nm, an increase in the film-thickness of the larger nano-particle silica film is possible. However, if the film-thickness of the larger nano-particle silica film is increased, the transmittance of the dielectric layer is reduced. In addition, even if the film-thickness of the larger nano-particle silica film is increased, the voltage resistance properties are not much enhanced, and cannot attain a sufficient value.

Figure 2:
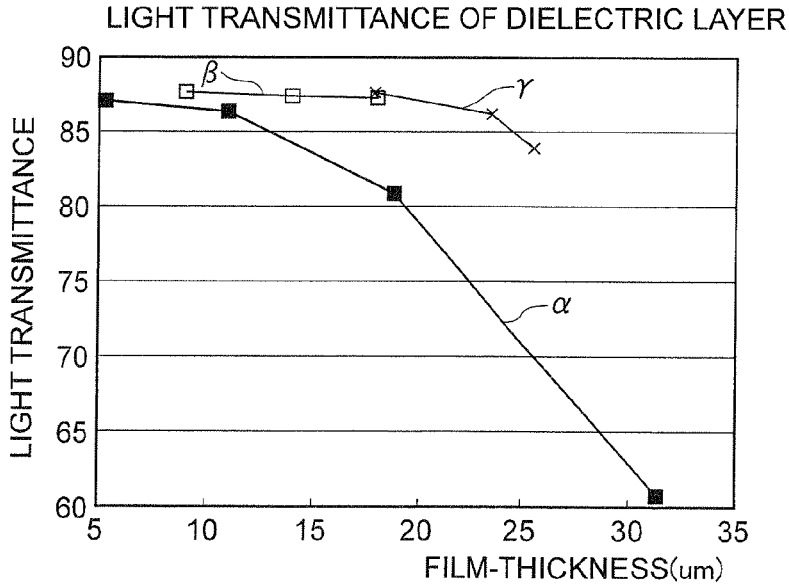
FIG. 2 is a graph showing a comparison between the light transmittances of the dielectric layer of the first embodiment and other layers.

FIG. 2 is a graph showing the relationship between the light transmittance and the film-thickness of the larger nano-particle silica film.

It is seen from FIG. 2 that, with an increase in the film-thickness, the light transmittance decreases rapidly in the larger nano-particle silica film formed of nano-particle silica of a 40-nm particle diameter (graph α), as compared with the cases of the smaller nano-particle silica film formed of nano-particle silica of a 20-nm particle diameter (graph β) and of a double layer film made up of a larger nano-particle silica film formed of nano-particle silica of a 40-nm particle diameter and a smaller nano-particle silica film formed of nano-particle silica of a 20-nm particle diameter (graph γ).

Since the aforementioned PDP is provided with a dielectric layer 2 having a double layer structure made up of a lamination of the first dielectric layer 2A formed of the smaller nano-particle silica film and the second dielectric layer formed of the larger nano-particle silica film, the PDP can successfully reduce the electrical power consumption while improving the luminous efficiency. In addition, because the dielectric layer 2 is formed in a required film-thickness, the dielectric layer 2 is capable of having voltage resistance properties sufficient to withstand the applied voltage which are not attained when the dielectric layer is formed of the smaller nano-particle silica film alone. Also, as compared with the case when the dielectric layer is formed of larger nano-particle silica alone to increase the voltage resistance properties, a restraint on the reduction of the light transmittance of the dielectric layer is made possible.

Typically, when a smaller nano-particle silica film is laminated on a larger nano-particle silica film, a crack may possibly occur in the smaller nano-particle silica film. However, in the PDP according to the embodiment, the occurrence of a crack in the dielectric layer 2 can be prevented, because the second dielectric layer 2B formed of the larger nano-particle silica film is deposited on the first dielectric layer 2A formed of the smaller nano-particle silica film to form the dielectric layer 2. As a result, an improvement in product yield in the manufacturing process is made possible.

Figure 3:
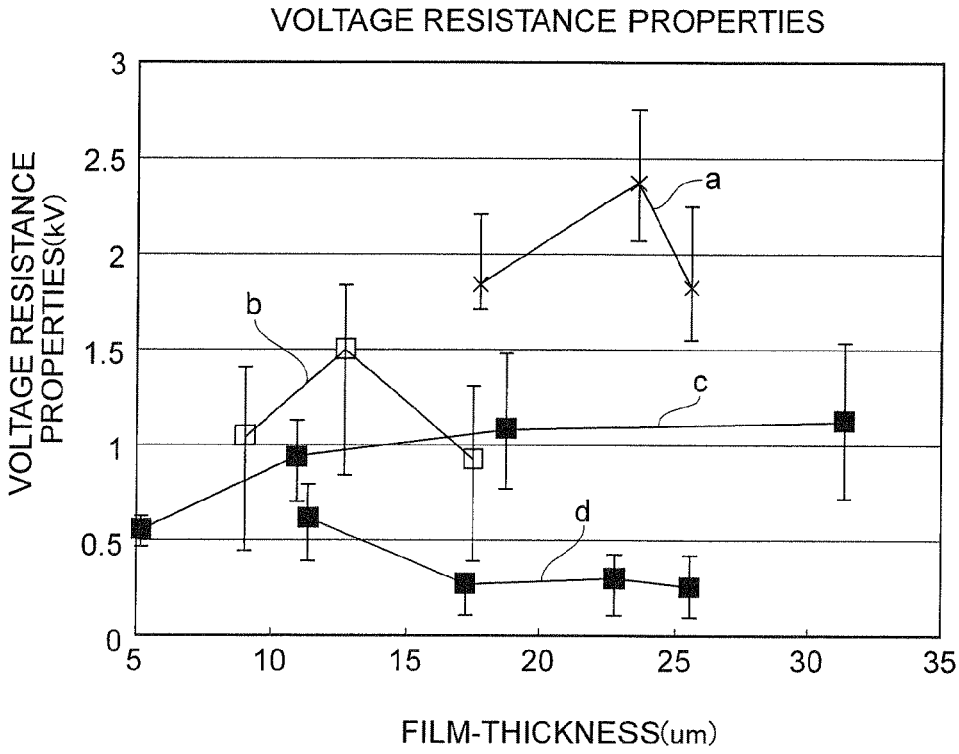
FIG. 3 is a graph showing a comparison between the voltage resistance properties of the dielectric layer of the first embodiment and other layers.

FIG. 3 is a graph showing a comparison between the film-thickness and the voltage resistance properties of the aforementioned dielectric layer 2 according to the embodiment and those of each of the following three dielectric layers: the dielectric layer formed of the smaller nano-particle silica film alone, the dielectric layer formed of the larger nano-particle silica film alone, and the dielectric layer formed of a lamination of a larger nano-particle silica film overlying a smaller nano-particle silica film.

In FIG. 3 the horizontal axis represents the film-thickness of the dielectric layer and the vertical axis represents the voltage resistance properties to the applied voltage. Graph a shows a dielectric layer 2 formed of a lamination of the smaller nano-particle silica film (the first dielectric layer 2A) with the larger nano-particle silica film (the second dielectric layer 2B) deposited thereon. Graph b shows a dielectric layer formed of the smaller nano-particle silica film alone. Graph c shows a dielectric layer formed of the larger nano-particle silica film alone. Finally, graph d shows a dielectric layer formed of a lamination of the larger nano-particle silica film with the smaller nano-particle silica film deposited thereon.

Each of the smaller nano-particle silica films described in FIG. 3 is formed of nano-particle silica of a 20-nm particle diameter. Each of the larger nano-particle silica films described in FIG. 3 is formed of nano-particle silica of a 40-nm particle diameter FIG. 3 shows the relationship between the film-thickness and the voltage resistance properties of the dielectric layer when the row electrode is provided with a transparent electrode alone.

As seen from graph b in FIG. 3, the film-thickness of the dielectric layer formed of the smaller nano-particle silica film alone cannot be increased, which makes it impossible to attain sufficient voltage resistance properties for withstanding an applied voltage.

As seen from graph c, the film-thickness of the dielectric layer formed of the larger nano-particle silica film alone can be increased. However, even if the film-thickness of the dielectric layer is increased, it is impossible to attain sufficient voltage resistance properties for withstanding an applied voltage.

As seen from graph d, the dielectric layer formed of a lamination of the larger nano-particle silica film with the smaller nano-particle silica film deposited thereon has a crack occurring in the smaller nano-particle silica film. For this reason, even if the film-thickness of the dielectric layer can be increased, a reduction in voltage resistance properties results.

By contrast, on the dielectric layer 2 of the PDP according to the embodiment which is formed of a lamination of the smaller nano-particle silica film (the first dielectric layer 2A) with the larger nano-particle silica film (the second dielectric layer 2B) deposited thereon, as seen from graph a, the thickness (film-thickness) of the dielectric layer 2 can be increased without the occurrence of a crack in the smaller nano-particle silica film because the larger nano-particle silica film is laminated on the smaller nano-particle silica film, which makes it possible to attain sufficient voltage resistance properties for withstanding an applied voltage.

In addition, since it is not only an increase in the film-thickness of the larger nano-particle silica film that increases the layer-thickness of the dielectric layer 2, it is possible to prevent the light transmittance from being reduced by the larger nano-particle silica film.

Second Embodiment

Figure 4:
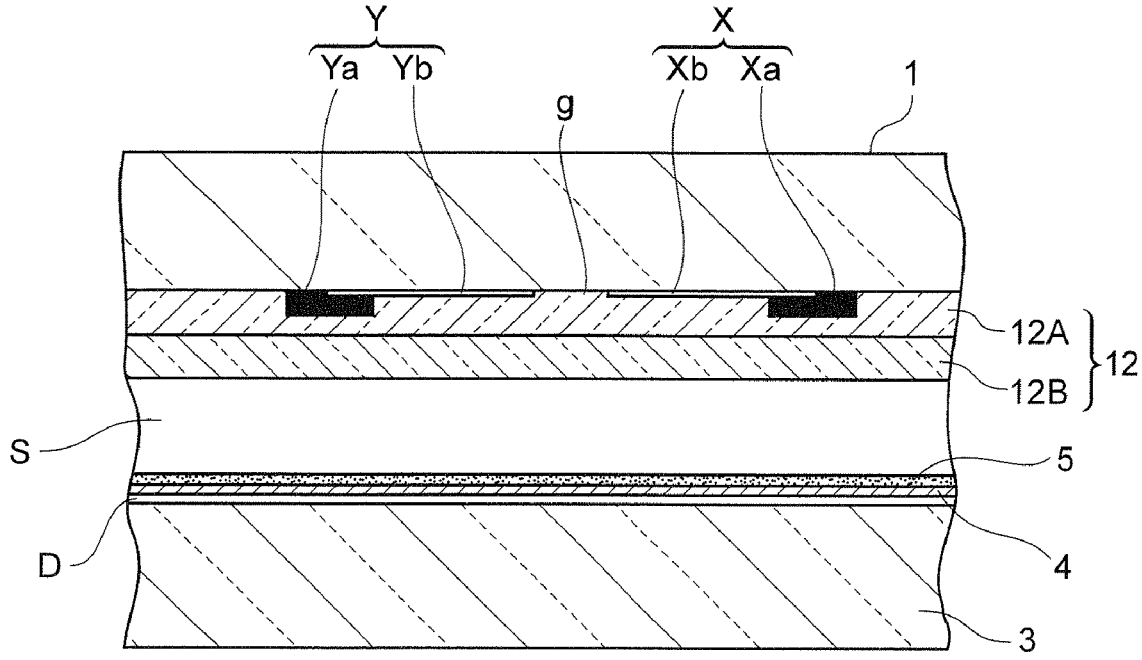
FIG. 4 is a sectional view illustrating a second embodiment of the PDP according to the present invention.

FIG. 4 is a sectional view illustrating a second embodiment of the exemplary embodiments of the PDP according to the present invention.

The structure of the PDP of the second embodiment is the same as that of the PDP described in the first embodiment, except for a dielectric layer 12 covering the row electrode pairs (X, Y) deposited on the inner face of the front glass substrate 1, and the same components as those in the PDP of the first embodiment are designated in FIG. 4 with the same reference numerals as in FIG. 1.

In FIG. 4, the dielectric layer 12 has a double layer structure made up of a first dielectric layer 12A directly covering the row electrode pairs (X, Y) arranged on the inner face of the front glass substrate 1, and a second dielectric layer 12B deposited on the first dielectric layer 12A.

The first dielectric layer 12A comprises a smaller nano-particle silica film formed of nano-particle silica having a particle diameter from 10 nm to 25 nm as in the case of the first embodiment.

The second dielectric layer 12B is formed of a leadless glass material such as one including $Bi_2O_3$ or ZnO, and has a film-thickness from 3 μm to 20 μm.

The reason why the dielectric layer 12 has a double layer structure made up of a first dielectric layer 12A formed of the smaller nano-particle silica film and a second dielectric layer 12B formed of the leadless glass material will be described. If a dielectric layer is formed on a smaller nano-particle silica film alone for the purpose of a reduction in electric power consumption and an improvement in the luminous efficiency of the PDP, the ensuring of the required voltage resistance properties to an applied voltage is made impossible because the film-thickness of the smaller nano-particle silica film cannot be increased.

The reason why the second dielectric layer 12B is deposited on the first dielectric layer 12A is to avoid a crack that may possibly occur in the smaller nano-particle silica film when the first dielectric layer 12A formed of the smaller nano-particle silica film is deposited on the second dielectric layer 12B formed of the leadless glass material.

The dielectric layer 12 of the PDP according to the embodiment has a double layer structure made up of a first dielectric layer 12A formed of the smaller nano-particle silica film and a second dielectric layer 12B formed of the leadless glass material and deposited on the first dielectric layer 12A. In consequence, a reduction in the electric power consumption and an improvement in the luminous efficiency of the PDP can be achieved because of the smaller nano-particle silica film. In addition, the dielectric layer 12 can be deposited to a film-thickness necessary for making it possible to impart voltage resistance properties sufficient to withstand the applied voltage to the PDP, which cannot be achieved by the smaller nano-particle silica film alone. Further, the occurrence of a crack in the smaller nano-particle silica film is prevented.

Figure 5:
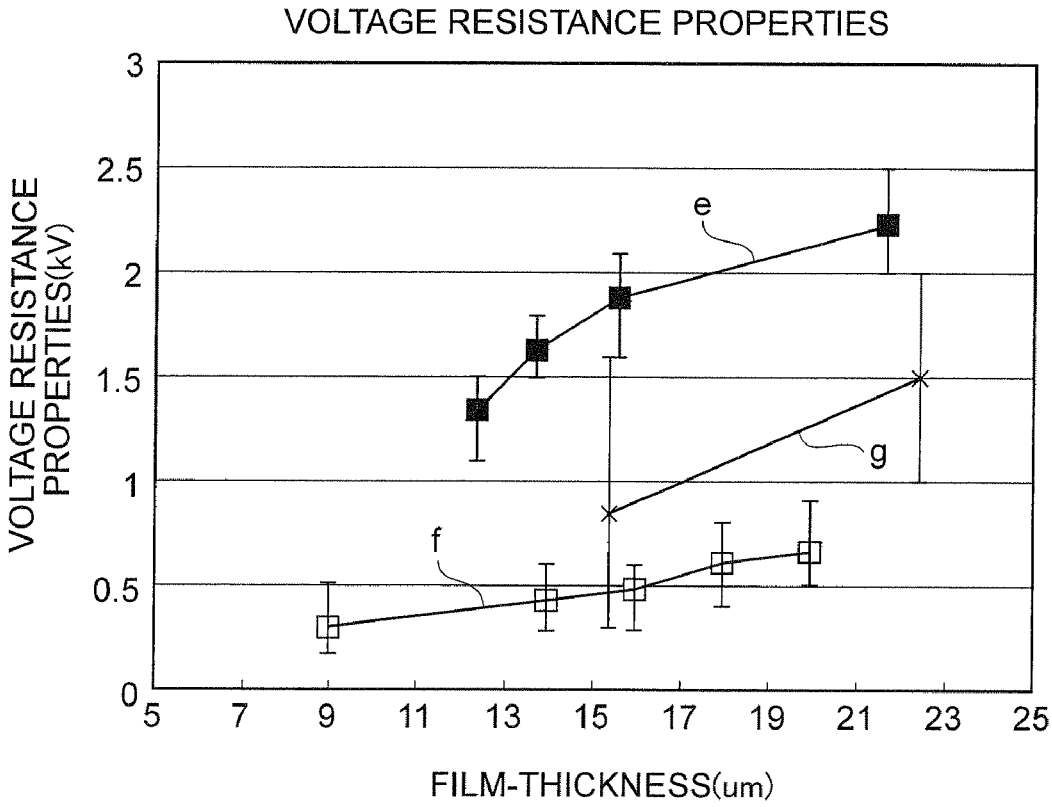
FIG. 5 is a graph showing a comparison between the voltage resistance properties of the dielectric layer of the second embodiment and other layers.

FIG. 5 is a graph showing a comparison between the film-thickness and the voltage resistance properties of the aforementioned dielectric layer 12 according to the embodiment and those of each of the following two dielectric layers: a dielectric layer formed of the smaller nano-particle silica film alone, and a dielectric layer formed of the smaller nano-particle silica film deposited on the leadless glass layer.

In FIG. 5 the horizontal axis represents the film-thickness of the dielectric layer and the vertical axis represents the voltage resistance properties to the applied voltage. Graph e shows a dielectric layer 12 formed of a lamination of the smaller nano-particle silica film (the first dielectric layer 12A) and the leadless glass material layer (the second dielectric layer 12B) deposited thereon. Graph f shows a dielectric layer formed of the smaller nano-particle silica film alone. Graph g shows a dielectric layer formed of a lamination of the smaller nano-particle silica film deposited on a dielectric layer formed of the leadless glass material.

FIG. 5 shows the relationship between the film-thickness and the voltage resistance properties of the dielectric layer when the row electrode has a bus electrode and a transparent electrode.

As seen from graph f in FIG. 5, the film-thickness of a dielectric layer formed of the smaller nano-particle silica film alone cannot be increased, which makes it impossible to attain sufficient voltage resistance properties for withstanding an applied voltage.

As seen from graph g, the film-thickness of a dielectric layer formed of a lamination of the smaller nano-particle silica film deposited on a dielectric layer formed of the leadless glass material can be increased. However, a crack occurs in the smaller nano-particle silica film, which makes impossible to attain the voltage resistance properties required of the PDP.

By contrast, on the dielectric layer 12 of the PDP according to the embodiment which is formed of a lamination of the smaller nano-particle silica film (the first dielectric layer 12A) overlying the dielectric layer formed of the leadless glass material (the second dielectric layer 12B), as seen from graph e, the thickness (film-thickness) of the dielectric layer 12 can be increased without the occurrence of a crack in the smaller nano-particle silica film because the dielectric layer formed of the leadless glass material is laminated on the smaller nano-particle silica film, which makes it possible to attaining sufficient voltage resistance properties to withstand an applied voltage.

In addition, because the second dielectric layer 12B laminated on the smaller nano-particle silica film (the first dielectric layer 12A) is formed of the leadless glass material, in the PDP according to the embodiment the adjustment of the relative permittivity of the dielectric layer 12 is made possible by adjusting the layer-thickness ratio between the first dielectric layer 12A and the second dielectric layer 12B.

Figure 6:
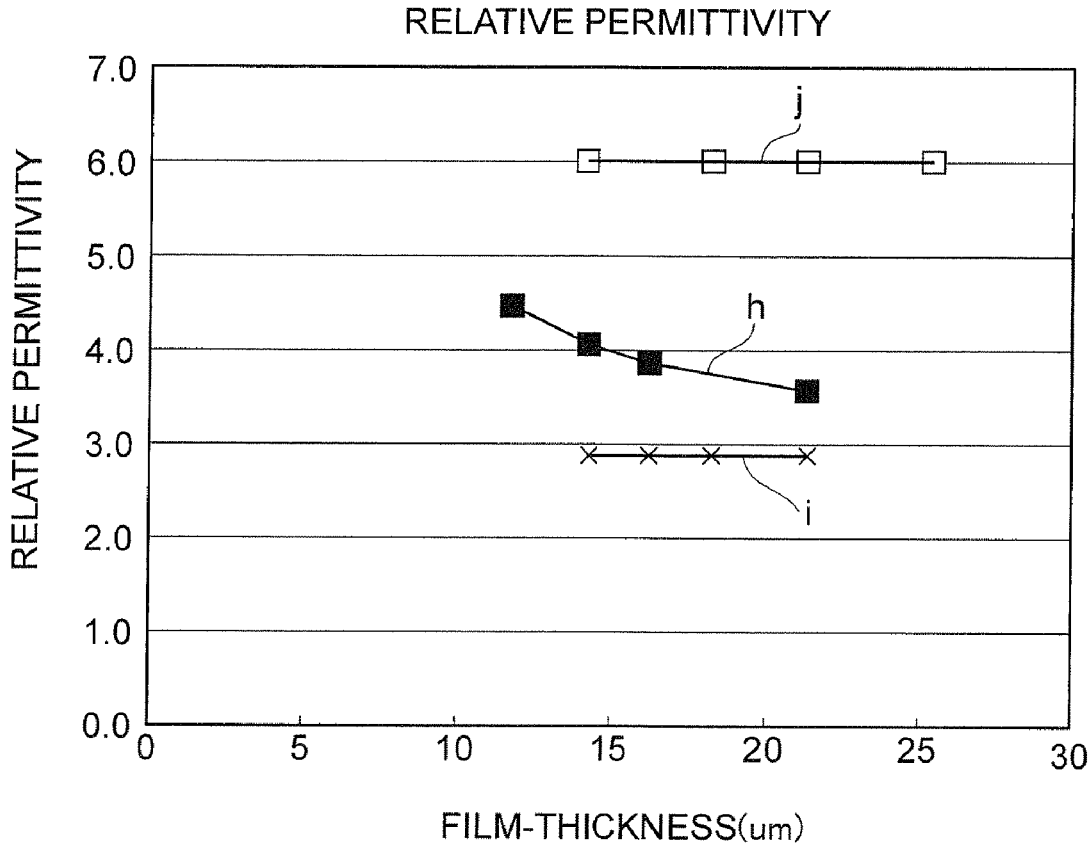
FIG. 6 is a graph showing a comparison between the relative permittivity of the dielectric layer of the second embodiment and other layers.

FIG. 6 is a graph showing a comparison of the relative permittivity of the dielectric layer 12 with that of the dielectric layer formed of the smaller nano-particle silica layer alone and that of the dielectric layer formed of the leadless glass material alone.

In FIG. 6 the vertical axis represents the relative permittivity of the dielectric layer and the horizontal axis represents the film-thickness of the dielectric layer. Graph h shows a dielectric layer 12 formed of a lamination of the smaller nano-particle silica film (the first dielectric layer 12A) overlying the dielectric layer formed of the leadless glass material (the second dielectric layer 12B). Graph i shows a dielectric layer formed of the smaller nano-particle silica film alone. Graph j shows a dielectric layer formed of leadless glass material alone.

In the dielectric layer 12 of graph h in FIG. 6, the layer-thickness of the second dielectric layer 12B formed of the leadless glass material is set at 7 μm.

As is seen from FIG. 6, the dielectric layer in graph i formed of the smaller nano-particle silica film has a low relative permittivity, but the dielectric layer in graph j formed of the leadless glass material has a high relative permittivity. The dielectric layer 12 in graph h formed of a lamination of the smaller nano-particle silica film (the first dielectric layer 12A) overlying the dielectric layer formed of the leadless glass material (the second dielectric layer 12B) is set to have a intermediate relative permittivity between that in graph i and that in graph j.

When the film-thickness of the first dielectric layer 12A (the smaller nano-particle silica film) is increased, the relative permittivity of the dielectric layer 12 is reduced. Thus, the setting of the film-thickness of the first dielectric layer 12A to a required value makes it possible to set the relative permittivity to a optimum value for the PDP.

For example, to provide a 7 μm-thick second dielectric layer 12B, the film-thickness of the first dielectric layer 12A (the smaller nano-particle silica film) is set to 7 μm. In this case, the relative permittivity of the dielectric layer 12 can be set to about 4.

Third Embodiment

Figure 7:
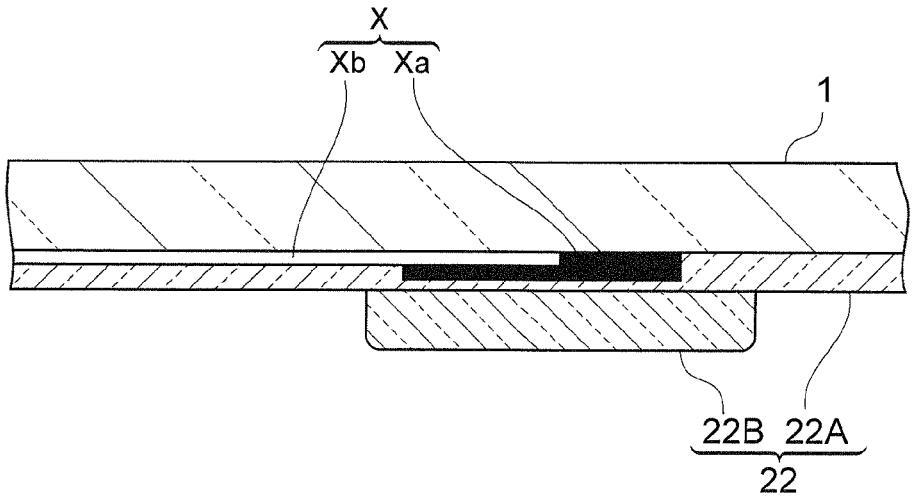
FIG. 7 is a sectional view illustrating a third embodiment of the PDP according to the present invention.

FIG. 7 is a sectional view illustrating a third embodiment of the exemplary embodiments of the PDP according to the present invention.

The structure of the PDP of the third embodiment is the same as that of the PDP described in the first embodiment, except for a dielectric layer 22 covering the row electrode pairs (X, Y) deposited on the inner face of the front glass substrate 1, and the same components as those in the PDP of the first embodiment are designated in FIG. 7 with the same reference numerals as in FIG. 1.

FIG. 7 only illustrates the structure of an area of the front glass substrate 1 in which the row electrode X of the row electrode pair (X, Y) is provided. The structure of the area around the row electrode X will be described below, and the same can be said of the area around the row electrode Y.

In FIG. 7, the dielectric layer 22 has a double layer structure made up of a first dielectric layer 22A directly covering the row electrode pairs (X, Y) arranged on the inner face of the front glass substrate 1, and second dielectric layers 22B deposited on the inner face of the first dielectric layer 22A.

As in the case of the first embodiment, the first dielectric layer 22A comprises the smaller nano-particle silica film formed of nano-particle silica having a particle diameter from 10 nm to 25 nm.

The second dielectric layers 22B are formed of the leadless glass material and deposited to a film-thickness of 3 μm to 20 μm.

In the second embodiment, a second dielectric layer formed of the leadless glass material is deposited so as to cover the entire inner face of the first dielectric layer. However, each of the second dielectric layers 22B is deposited on a portion of the first dielectric layer 22A facing the bus electrode Xa of the row electrode X extending in a belt shape in the row direction, and formed in a belt-shaped pattern extending parallel to the bus electrode Xa in the row direction.

In the PDP, because the transparent electrode Xb of the row electrode X functioning as the discharge initiating section is covered with only the smaller nano-particle silica film forming the first dielectric layer 22A of the dielectric layer 22, the low permittivity of the smaller nano-particle silica film causes a reduction in the electrostatic capacitance of the discharge initiating section, resulting in a reduction in electric power consumption and an improvement in luminous efficiency.

In addition, the smaller nano-particle silica film alone is insufficient for electrically insulating the bus electrode Xa, but the electrical insulation (the voltage resistance properties) of the bus electrode Xa is ensured. This is because the second dielectric layer 22B formed of the leadless glass material is formed on the portion of the first dielectric layer 22A of the dielectric layer 22 facing the bus electrode Xa of each row electrode X by patterning techniques.

Figure 8:
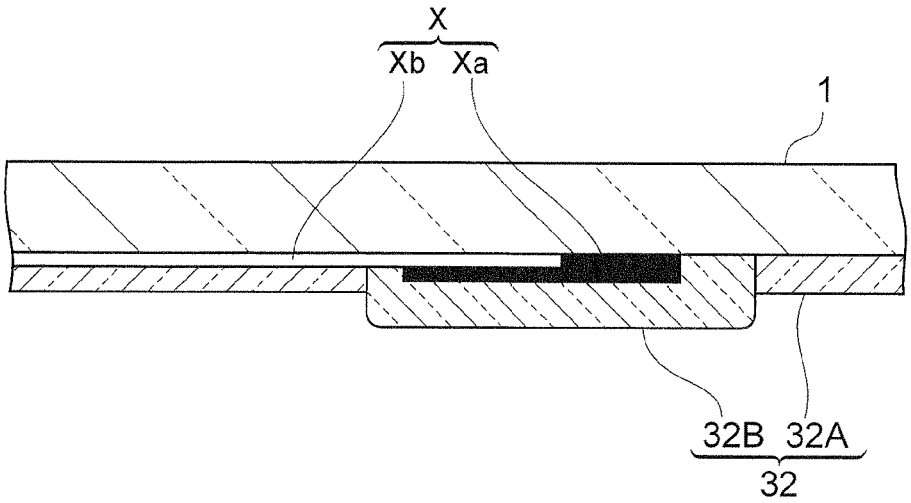
FIG. 8 is a sectional view illustrating a modification of the third embodiment.

FIG. 8 illustrates a modification of the PDP of the embodiment.

FIG. 7 shows the second dielectric layer 22B of the dielectric layer 22 formed on a portion of the first dielectric layer 22A facing each bus electrode Xa by use of patterning techniques. A dielectric layer 32 of the PDP shown in FIG. 8 has second dielectric layers 32B of the leadless glass material formed directly on the inner face of the front glass substrate 1. Each of the second dielectric layers 32B extends in a belt shape along the bus electrode Xa so as to cover the bus electrode Xa. A first dielectric layer 32A of the dielectric layer 32 formed of the smaller nano-particle silica film is deposited on an area of the inner face of the front glass substrate except for the area in which the second dielectric layers 32B are provided. Accordingly, the first dielectric layer 32A covers the transparent electrode Xb.

In the PDP as illustrated in FIG. 8, in addition to the advantageous technical effects of the PDP illustrated in FIG. 6, the electrical insulation (the voltage resistance properties) of the bus electrode Xa can be made even stronger than that of the PDP illustrated in FIG. 7.

Figure 9:
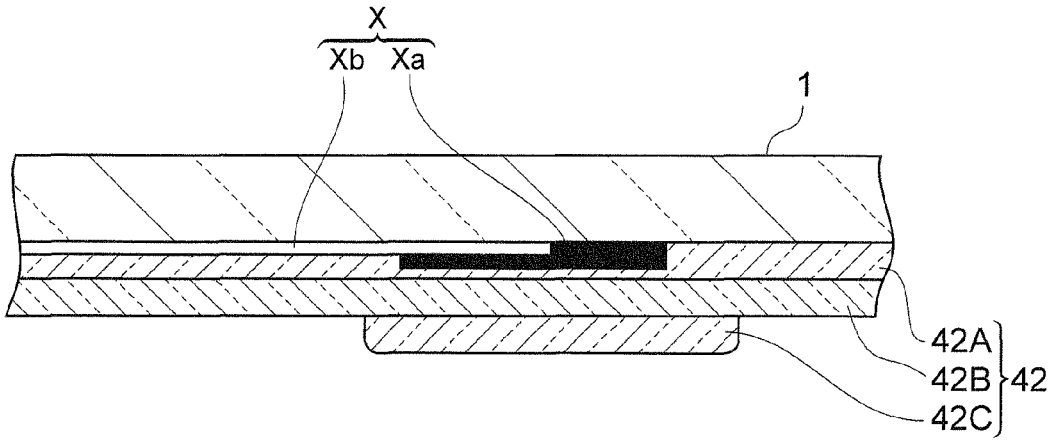
FIG. 9 is a sectional view illustrating another modification of the third embodiment.

FIG. 9 illustrates another modification of the PDP of the embodiment.

In FIG. 9, a dielectric layer 42 of the PDP is made up of a first dielectric layer 42A formed of the smaller nano-particle silica film, a second dielectric layer 42B formed of the leadless glass material, and third dielectric layers 42C. The first dielectric layer 42A is deposited on the inner face of the first substrate 1 so as to overlie the row electrodes X. The second dielectric layer 42B is deposited on the full inner face of the first dielectric layer 42A. The third dielectric layers 42C are patterned onto the full face of the second dielectric layer 42B, each of which is formed in a belt shape extending along the bus electrode Xa of the row electrode in the row direction and faces the bus electrode Xa.

Because of the structure in which the first dielectric layer 42A is formed of the smaller nano-particle silica film and the second dielectric layer 42B is formed of the leadless glass material and deposited on the full face of the first dielectric layer 42A which form part of the dielectric layer 42, the PDP illustrated in FIG. 9 is capable of exercising the same advantageous technical effects as those of the PDP of the second embodiment having a similar structure to the structure illustrated in FIG. 9. In addition, the third dielectric layers 42C, which are patterned in a belt shape onto the surface of the second dielectric layer 42B so as to be located respectively facing the bus electrodes Xa of the row electrodes, further enhance the electric insulation (the voltage resistance properties) of the bus electrode Xa as compared with the case of the PDP of the second embodiment.

Figure 10:
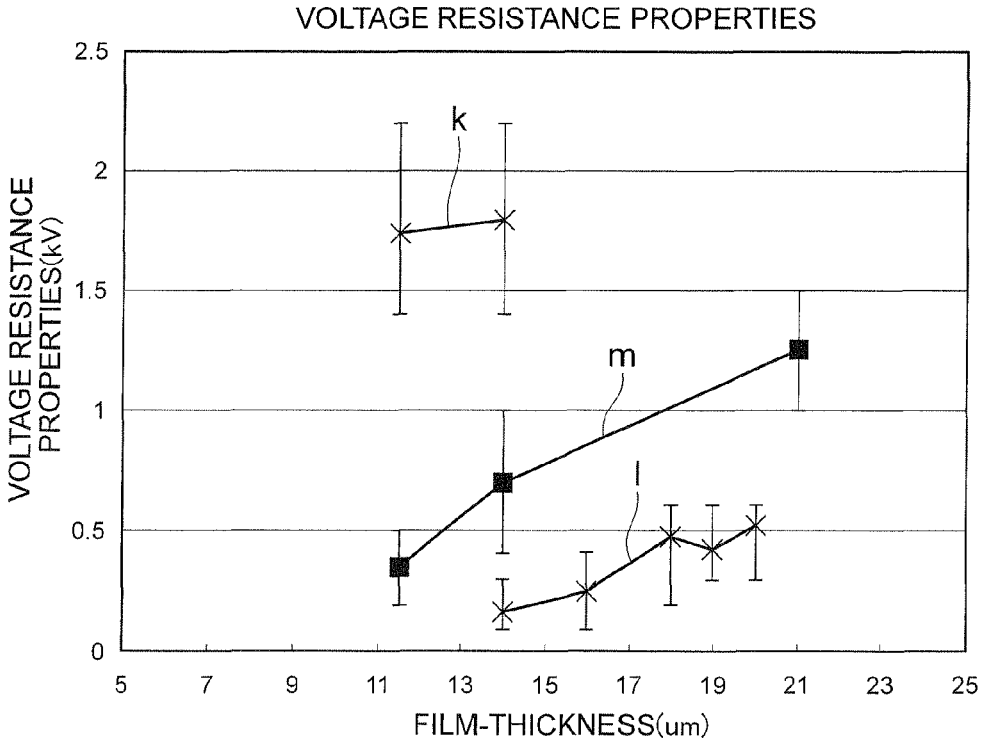
FIG. 10 is a graph showing a comparison between the voltage resistance properties of the dielectric layer of the modification and other layers.

FIG. 10 is a graph showing a comparisons of the film-thickness and the voltage resistance properties of the dielectric layer 42 shown in FIG. 9 and those of a dielectric layer formed of the smaller nano-particle silica film alone and those of a dielectric layer having a double layer structure in which a leadless glass layer is formed on the smaller nano-particle silica film (see FIG. 4).

In FIG. 10 the horizontal axis represents the film-thickness of the dielectric layer and the vertical axis represents the voltage resistance properties to an applied voltage. Graph k shows a dielectric layer 42 in which a dielectric layer formed of the leadless glass material (the second dielectric layer 42B) is deposited on the full face of the smaller nano-particle silica film (the first dielectric layer 42A), and then dielectric layers (the third dielectric layers 42C) formed of the leadless glass material are patterned onto the surface of the second dielectric layer 42B, respectively corresponding to the bus electrodes of the row electrodes. Graph 1 shows a dielectric layer formed of the smaller nano-particle silica film alone. Graph m shows a dielectric layer in which a leadless glass material layer of a thickness of 7 μm is deposited on the full face of the smaller nano-particle silica film.

In FIG. 10, the second dielectric layer 42B of the dielectric layer in graph k and the leadless glass material layer of the dielectric layer in graph m are both set to have a thickness of 7 μm.

FIG. 10 shows the relationship between the film-thickness and the voltage resistance properties of the dielectric layer when the row electrode has a bus electrode and a transparent electrode. The measurements in FIG. 10 differ from the case in FIG. 5 in the way of attaching the measurement probe.

As seen from graph k in FIG. 10, the dielectric layer 42, even when not having a very much great thickness, is capable of having the voltage resistance properties of withstanding a significantly higher voltage as compared with the dielectric layers shown in graph l and graph m.

Figure 11:
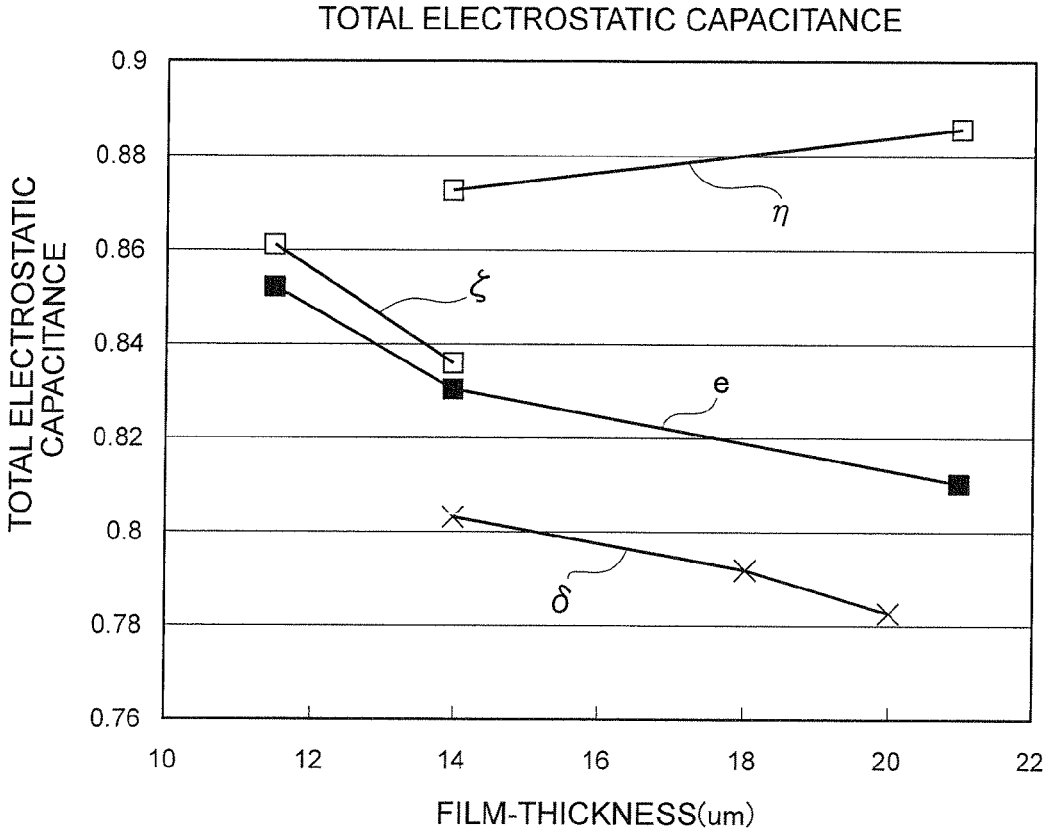
FIG. 11 is a graph showing a comparison of the total dielectric capacitance in the modification.

FIG. 11 is a graph showing the relationship between the total electrostatic capacitance of the panel and the film-thickness of the dielectric layer.

In FIG. 11, graph δ shows a dielectric layer formed of the smaller nano-particle silica film alone. Graph ϵ shows a dielectric layer having a double layer structure made up of the smaller nano-particle silica film and 7 μm-thick leadless glass material layers patterned onto the surface of the smaller nano-particle silica film and respectively facing the bus electrodes of the row electrodes, as in PDP shown in FIG. 7. Graph ζ shows a dielectric layer having a three layer structure made up of a smaller nano-particle silica film, a 7 μm-thick leadless glass material layer deposited on the full face of the smaller nano-particle silica film, and leadless glass material layers which are formed of the leadless glass material and patterned onto the surface of the leadless glass material layer so as to be located respectively corresponding to the bus electrodes of the row electrodes in a form raising the level of the leadless glass material layer, as in the PDP in FIG. 9. Graph η shows a dielectric layer formed of the leadless glass material layer alone.

As seen from graphs δ-ζ in FIG. 11, in a dielectric layer including the smaller nano-particle silica film, the thicker the film-thickness of the smaller nano-particle silica film, the greater the reduction in electrostatic capacitance.

As shown by graph δ, the total electrostatic capacitance of the panel is minimal when the dielectric layer is formed of the smaller nano-particle silica film alone. It is seen from this that, from among the above-described examples of the PDP, the PDPs illustrated in FIGS. 7 and 8, having a dielectric layer which is formed of the smaller nano-particle silica film alone and deposited on the whole area except for the area corresponding to the bus electrodes of the row electrodes, have the smallest total electrostatic capacitance.

Fourth Embodiment

Figure 12:
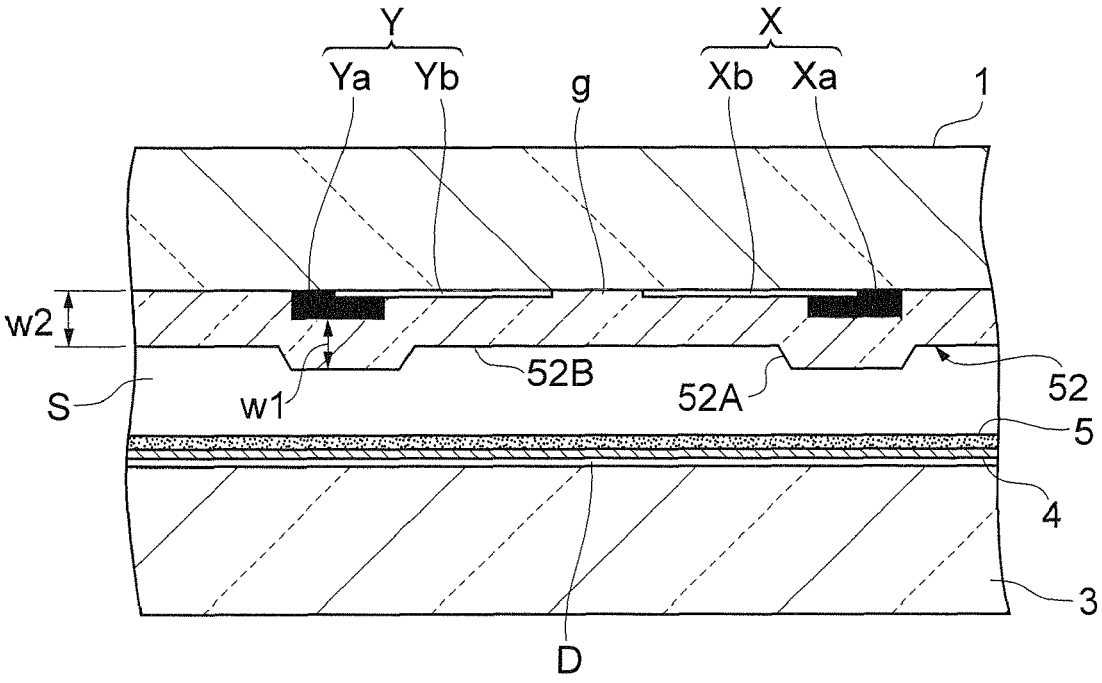
FIG. 12 is a sectional view illustrating a fourth embodiment of the PDP according to the present invention.

FIG. 12 is a sectional view illustrating a fourth embodiment of the exemplary embodiments of the PDP according to the present invention.

The structure of the PDP of the fourth embodiment is the same as that of the PDP described in the first embodiment, except for a dielectric layer 52 covering the row electrode pairs (X, Y) deposited on the inner face of the front glass substrate 1, and the same components as those in the PDP of the first embodiment are designated in FIG. 12 with the same reference numerals as in FIG. 1.

In FIG. 12, the dielectric layer 52 comprises the smaller nano-particle silica film alone which is formed of smaller nano-particle silica having a particle diameter 10 nm to 25 nm and covers the row electrode pairs (X, Y) arranged on the inner face of the front glass substrate 1. The portions of the smaller nano-particle silica film respectively facing the bus electrodes Xa, Ya of the row electrodes X, Y have a greater thickness than the other portions not facing the bus electrodes in such a manner as to protrude toward the inside of the discharge space. Therefore, each of the portions forms a protrusion 52A extending in the row direction on a portion of the inner face of the smaller nano-particle silica film facing the bus electrode Xa, Ya.

The thickness of the protrusion 52A of the dielectric layer 52 is determined such that the ratio of the film-thickness of the portion of the dielectric layer 52 facing the bus electrode Xa, Ya to the film-thickness of the portion of the dielectric layer 52 facing the transparent electrode Xb, Yb is 0.5 or more.

Such a protrusion 52A of the dielectric layer 52 can be achieved by use of, for example, a smaller nano-particle silica paste having a high viscosity of 1000 cP or more, and drying it at high speed using IP drying or the like.

In the PDP the dielectric layer 52 is provided with the protrusions 52A respectively facing the bus electrodes Xa, Ya of the row electrodes X, Y, thus improving the electrical insulation (the voltage resistance properties) of the bus electrodes Xa, Ya.

Figure 13A:
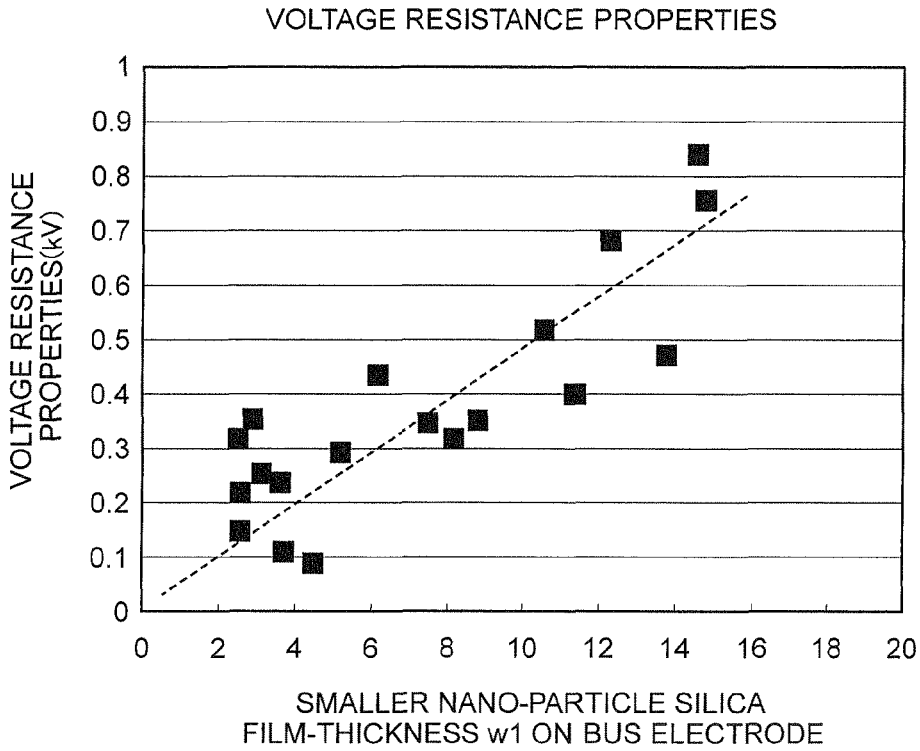
FIG. 13A is a graph showing the relationship between the voltage resistance properties and the film-thickness of the dielectric layer in the fourth embodiment.
Figure 13B:
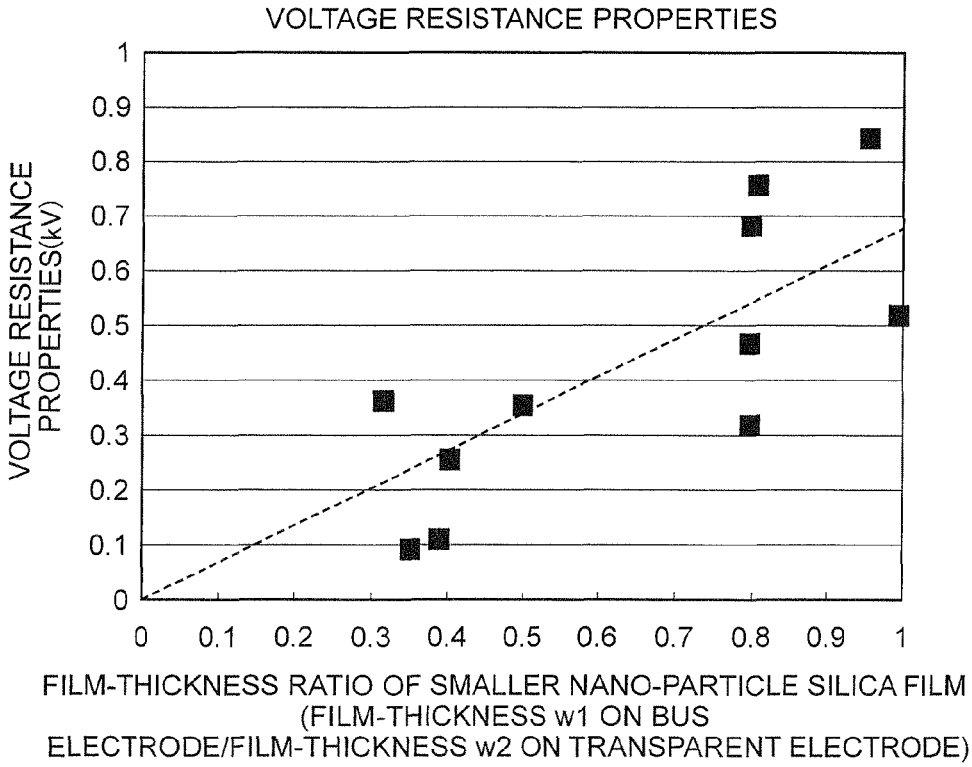
FIG. 13B is a graph showing the relationship between the voltage resistance properties and the ratios of the film-thickness of the dielectric layer in the fourth embodiment.

FIG. 13A and FIG. 13B are graphs showing the relationships between the film-thickness and the voltage resistance properties of the dielectric layer 52.

FIG. 13A shows the relationship between the voltage resistance properties and the film-thickness w1 of the portion of the dielectric layer 52 facing each bus electrode. FIG. 13B shows the relationship between the voltage resistance properties and a ratio (w1/w2) between the film-thickness w1 of the portion of the dielectric layer 52 facing each bus electrode and the film-thickness w2 of the portion facing each transparent electrode.

It is seen from FIG. 13A that the greater the film-thickness w1 of the portion of the dielectric layer 52 overlying each of the bus electrodes Xa, Ya, the greater the improvement in the voltage resistance properties and the electrical insulation of the bus electrode Xa, Ya. It is also seen from FIG. 13B that the greater the ratio (w1/w2) between the film-thickness w1 of the portion of the dielectric layer 52 facing the bus electrode and the film-thickness w2 of the portion facing the transparent electrode, the greater the improvement in the electrical insulation (the voltage resistance properties) of the bus electrodes Xa, Ya.

In the basic idea of the PDPs described in the foregoing embodiments illustrated in FIGS. 1, 4, 7 and 9, a PDP comprises discharge electrodes deposited on the inner face of a front substrate and a dielectric layer overlying the discharge electrodes, with the front substrate facing a back substrate to define a discharge space filled with a discharge gas, in which the dielectric layer has a structure of a lamination of a first dielectric layer including silica particles having a particle diameter of 40 nm or less and a second dielectric layer different from the first dielectric layer.

In the basic idea of the PDP illustrated in the foregoing embodiment of FIG. 8, a PDP comprises discharge electrodes deposited on the inner face of a front substrate and a dielectric layer overlying the discharge electrodes, with the front substrate facing a back substrate to define a discharge space filled with a discharge gas, in which each of the discharge electrodes has a bus electrode extending in the row direction and a transparent electrode connected to the bus electrode and facing another discharge electrode paired with the discharge electrode across a discharge gap, and the dielectric layer has a fourth dielectric layer including silica particles having a particle diameter of 40 nm or less and fifth dielectric layers different from the first dielectric layer, with the fourth dielectric layer covering the transparent electrodes of the discharge electrodes, and the fifth dielectric layers covering the bus electrodes of the discharge electrodes and protruding further into the discharge space than the fourth dielectric layer does.

In the basic idea of the PDP illustrated in the foregoing embodiment of FIG. 12, a PDP comprises discharge electrodes deposited on the inner face of a front substrate and a dielectric layer overlying the discharge electrodes, with the front substrate facing a back substrate to define a discharge space filled with a discharge gas, in which the dielectric layer is formed of a nano-silica film including silica particles having a particle diameter of 40 nm or less, and each of the discharge electrodes has a bus electrode extending in the row direction and a transparent electrode connected to the bus electrode and facing another discharge electrode paired with the discharge electrode across a discharge gap, and also portions of the dielectric layer respectively facing the bus electrodes of the discharge electrodes protrude further into the discharge space than portions of the dielectric layer facing the transparent electrodes and the area excluding the bus electrodes.

The terms and description used herein are set forth by way of illustration only and are not meant as limitations. Those skilled in the art will recognize that numerous variations are possible within the sprit and scope of the invention as defined in the following claims.

What is claimed is:

1. A plasma display panel, comprising:

discharge electrodes deposited on the inner face of a front substrate; and a dielectric layer overlying the discharge electrodes, with the front substrate facing a back substrate to define a discharge space filled with a discharge gas, wherein:

the dielectric layer has a structure of a lamination of a first dielectric layer and a second dielectric layer different from the first dielectric layer;

the first dielectric layer is formed of a small nano-particle silica film including silica particles having a particle diameter ranging from 10 nm to 25 nm, the first dielectric layer is a porous silica dielectric layer having a relative permittivity of 2.6, a density of 60% and a light transmittance of 99% or more;

the second dielectric layer is formed of a large nano-particle silica film including silica particles having a particle diameter ranging from 25 nm to 40 nm, the second dielectric layer has a thickness ranging from 3 μm to 20 μm; and the second dielectric layer is deposited on the first dielectric layer.

2. A plasma display panel, comprising:

discharge electrodes deposited on the inner face of a front substrate; and a dielectric layer overlying the discharge electrodes, with the front substrate facing a back substrate to define a discharge space filled with a discharge gas, wherein the dielectric layer has a structure of a lamination of a first dielectric layer and a second dielectric layer different from the first dielectric layer;

wherein the first dielectric layer is formed of a small nano-particle silica film including silica particles having a particle diameter ranging from 10 nm to 25 nm;

wherein the first dielectric layer is a porous silica dielectric layer having a relative permittivity of 2.6, a density of 60% and a light transmittance of 99% or more;

wherein the second dielectric layer is formed of a leadless glass material;

wherein the second dielectric layer has a thickness ranging from 3 μm to 20 μm; and wherein the second dielectric layer is deposited on the first dielectric layer.

3. The plasma display panel according to claim 2, wherein each of the discharge electrodes has a bus electrode extending in a row direction, and a transparent electrode connected to the bus electrode and facing another discharge electrode paired with the discharge electrode across a discharge gap, the second dielectric layer is formed on an area facing a portion of the discharge electrode including the bus electrode, and a portion of the transparent electrode including the leading end close to the discharge gap is covered with the first dielectric layer alone.

4. The plasma display panel according to claim 2, wherein each of the discharge electrodes has a bus electrode extending in a row direction, and a transparent electrode connected to the bus electrode and facing another discharge electrode paired with the discharge electrode across a discharge gap, the second dielectric layer overlies the surface of the first dielectric layer, and the dielectric layer further includes a third dielectric layer formed on a portion of the second dielectric layer facing a portion of the discharge electrode including the bus electrode.

* * * * *